US006435989B1

(12) United States Patent
Grubman

(10) Patent No.: US 6,435,989 B1
(45) Date of Patent: Aug. 20, 2002

(54) BATTING TRAINING DEVICE

(75) Inventor: Joel Grubman, 521 Davis Rd., Cheltenham, PA (US) 19012

(73) Assignee: Joel Grubman, Cheltenham, PA (US)

( * ) Notice: Subject to any disclaimer, the term of this patent is extended or adjusted under 35 U.S.C. 154(b) by 0 days.

(21) Appl. No.: 09/579,715

(22) Filed: May 26, 2000

(51) Int. Cl.[7] ..... A63B 69/00

(52) U.S. Cl. ..... 473/422; 473/423; 473/424

(58) Field of Search ..... 473/422–427, 473/219, 227, 229, FOR 101, FOR 103, FOR 108, FOR 109, FOR 160, FOR 213, 415, 451, 458, 459, 464, 469, 475; 482/22; 273/331, 332, 334, 335, 317.6

(56) References Cited

U.S. PATENT DOCUMENTS

| | | | | | |
|---|---|---|---|---|---|
| 2,765,170 | A | * | 10/1956 | Brown | 473/424 |
| 2,942,883 | A | * | 6/1960 | Moore | 473/424 |
| 3,114,546 | A | * | 12/1963 | Verseghy | 473/575 |
| 3,907,287 | A | * | 9/1975 | Fox et al. | 473/424 |
| 4,022,467 | A | * | 5/1977 | Ruess | 473/464 |
| 4,415,155 | A | * | 11/1983 | Goudreau et al. | 473/424 |
| 4,513,965 | A | * | 4/1985 | Aschermann | 473/458 |
| 4,784,389 | A | * | 11/1988 | Taylor | 473/424 |
| 4,846,472 | A | * | 7/1989 | Terza | 473/424 |
| 4,964,634 | A | * | 10/1990 | Boyer | 473/423 |
| 5,452,888 | A | * | 9/1995 | Glenn | 473/424 |
| 5,492,321 | A | * | 2/1996 | Cipriano | 473/424 |

OTHER PUBLICATIONS

Nedco Sports Products, Inc., "Hit2win Trainer The Next Generation Handheld Trainer Drills Instruction Manual", 1 page.

Hit2win.com, Welcome homepage, 2 pages.

* cited by examiner

*Primary Examiner*—Paul T. Sewell
*Assistant Examiner*—Mitra Aryanpour
(74) *Attorney, Agent, or Firm*—LaRiviere, Grubman & Payne, LLP

(57) ABSTRACT

A ball-like target, representative of a ball to be used in actually playing a sport to be taught, for use in teaching batting and catching to new players. The ball-like target is attached to an apparatus that allows a trainer to control the target's speed and attitude of presentation to a trainee. The trainer can then explain in whatever detail is necessary for the trainee to understand the instructions being provided and the trainee can respond accordingly. The device improves training efficiency by allowing the trainer to retain possession and control of the ball. The ultimate results for the trainee are improved eye-hand coordination, many practice swings at an actual ball per unit time, immediate feed back on the result of each swing, and improved self-confidence as more and more contact is made by the bat with the ball, especially in young ball players.

15 Claims, 2 Drawing Sheets

BATTING TRAINING DEVICE

TECHNICAL FIELD OF THE INVENTION

The present invention is a device and method for providing "practice batting" for sports such as baseball. The invention provides a ball suitable for the sport to be learned attached to a handle which allows a trainer to controllably present the ball to a trainee in a manner realistic for the sport and the degree of skill of the trainee. The invention will be best understood by reference to the following discussion and the associated figures.

BACKGROUND ART

When a new player begins to learn how to play a ball game such as baseball, one of the fundamental requirements is to learn how to hit and catch the ball. In past batting practice, the trainer would toss the ball to the trainee and issue verbal instructions such as "swing" or "keep your eye on the ball". To a new student, the proper way to execute these instructions would not be immediately clear and a long, iterative process would ensue. Other methods of presenting a ball to a trainee include hanging a ball by a string, placing a ball on a support, or ejecting a ball from a machine. Some trainees may master these instructions quickly but in the vast majority of cases the learning process continues for an extended period, occasionally extending to months or more to achieve acceptable mastery. What is needed is a way to present the ball to the trainee in such a manner that the instructions can be given in complete sentences and at such a speed that the trainer can utter them and the trainee can comprehend them, while at the same time attempting to hit the ball.

The disadvantages of the prior practices are numerous and obvious. The trainer loses control of the ball when it leaves his hand. The trainee has an extremely brief time to react to the ball, frequently missing the ball entirely. The missed ball must then be retrieved and the trainer and trainee must then resume their positions before the lesson can be repeated. This method of training is highly in efficient in the use of time and the speed at which the trainee learns. These disadvantages are all overcome by the present invention. The present invention provides a ball, representative of the ball to be used in actually playing the sport being taught, attached to an apparatus that allows the trainer to control the ball's speed and attitude of presentation to the trainee. The invention and manner of its use to overcome these disadvantages are described below.

BRIEF DISCLOSURE OF THE INVENTION

The present invention provides a ball, representative of the ball to be used in actually playing the sport being taught, attached to a handle apparatus that allows the trainer, acting as a pitcher, to control the ball's speed and attitude of presentation to the trainee, acting as a batter. The trainer can then explain in whatever detail is necessary for the trainee to understand the instructions being provided and the trainee can respond accordingly. This provides the trainee with instructions and practice at a speed commensurate with his or her ability, allowing the trainee to more quickly grasp the lesson being presented. The ultimate results for the trainee are improved eye-hand coordination, many practice swings at an actual ball per unit time, immediate feed back on the result of each swing, and improved self-confidence as more and more contact is made by the bat with the ball, especially in young ball players. Other features of the present invention are disclosed or apparent in the section entitled "Best Mode for Carrying Out the Invention".

BRIEF DESCRIPTION OF DRAWINGS

For fuller understanding of the present invention, reference is made to the accompanying drawing in the following detailed description of the Best Mode For Carrying Out the Invention. In the drawing.

Figure 1:
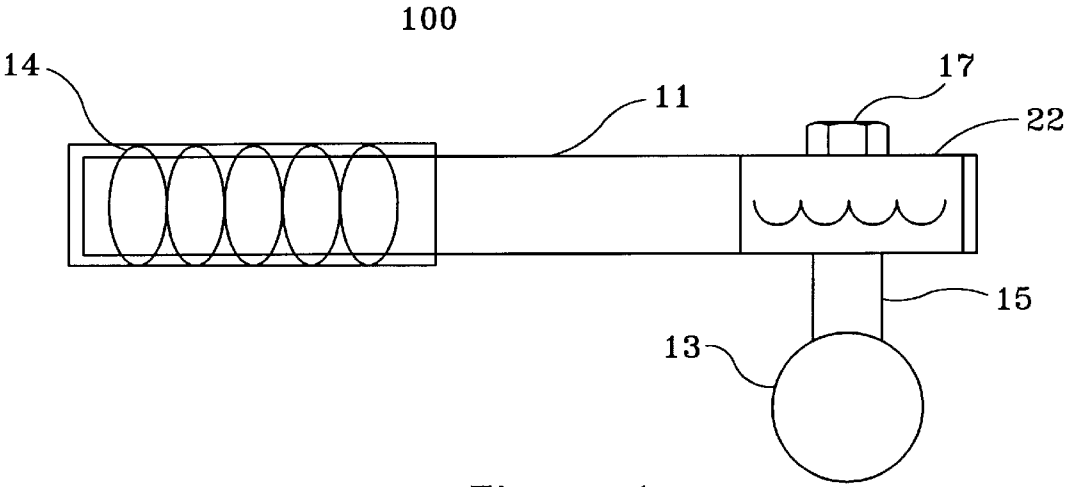
FIG. 1 is a side view of the present invention.

Reference numbers refer to the same or equivalent parts of the present invention throughout the several figures of the drawing.

BEST MODE FOR CARRYING OUT THE INVENTION

The present invention is illustrated in FIG. 1. Apparatus 100 is formed of a substantially rigid rod 11 of preferably round cross section having a handle 14 at one end and a ball 13 attached at the other end. Rod 11 can be composed of any material which is sufficiently sturdy to withstand multiple impacts from another object such as a baseball bat. Rod 11 is of a convenient length between 30 inches and 48 inches, preferably approximately 36 inches. Rod 11 may be of any convenient diameter suitable to the material of construction to allow strength yet remain light enough for the trainer to repeatedly move and hold the ball 13 out in an extended position. For example, approximately 1.25 inches in diameter has been found to be suitable if rod 11 is made of wood. Rod 11 should not exceed 2 inches in diameter to preclude it obscuring ball 13 or distracting the trainee when apparatus 100 is in use. Rod 11 may be fabricated of wood, metal or a polymeric composite, or hollow metal tubing, the constraint being total weight. Apparatus 100 should weigh between 1 and 4 pounds, preferably approximately 2 pounds so that it may be held at handle 14 and swung in a slow or moderately fast motion by an average person.

Handle 14 may be composed of any resilient material placed on rod 11 as is known in the art for enhancing the gripping surface. Preferably handle 14 extends for approximately 10 inches along the length of rod 11, but may be as short as 6 inches or as long as 18 inches. If desired, handle 14 may be deleted without varying from the present invention. A circumferential protrusion (not shown), if desired, may be added to the handle end of rod 11 in the same style as for the handle end of a baseball bat as is well known in the art.

At the end of rod 11 opposite handle 14 a "hitting target", which will usually be a type of ball 13, is attached. Ball 13 should be of similar size, shape, and feel as an actual ball used in the sport for which the invention will provide practice. For example, if apparatus 100 is used to instruct for conventional baseball ("hardball"), ball 13 should closely approximate a standard baseball as used in that sport. If the invention is to be used to instruct for "softball", then ball 13 should resemble a softball as used in that sport. Other batting sports such as cricket would require a ball representative of that sport. In the preferred embodiment, actual hard and soft balls from the sport are modified and attached to apparatus 100 as described below.

Figure 2A:
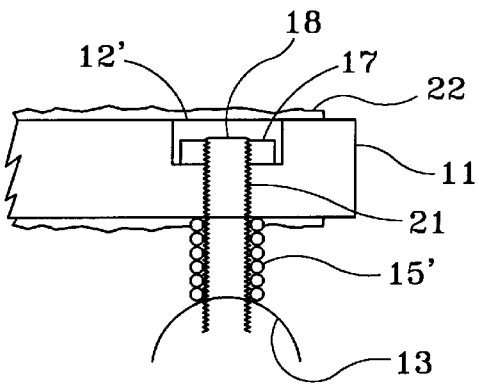
FIG. 2A is an alternate configuration of the present invention shown in FIG. 2.
Figure 2:
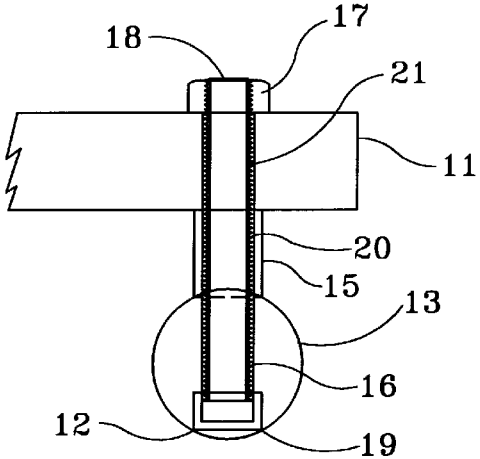
FIG. 2 is a detailed sectional view of the attachment of the ball portion of the present invention.

Referring now to FIG. 2, ball 13 is mounted approximately 3 inches from one end of rod 11. Ball 13 is spaced apart from rod 11 by means of a spacer 15. Spacer 15 is preferably a cylindrical tube of a length between one-half inch to two inches, preferably approximately 1¼ inch. Spacer 15 may be of any convenient diameter with an outer diameter in the range of ½ inch to 1¼ inch, preferably approximately ¾ inch. The inner diameter 20 is selected to provide a near-friction fit to accommodate a bolt 18 passing through spacer 15. Hole 21 through rod 11 is similarly sized to provide a near-friction fit for bolt 18 and is located approximately 3 inches from the end of rod 11. In an alternative configuration, spacer 15 may be a stiff spring 15' as shown in FIG. 2A.

Ball 13 is bored with a hole 16 passing through the center of ball 13. Hole 16 is selected to have a diameter closely approximating that of bolt 18 to provide a close fit. One end of hole 16 may be enlarged with a recess 12 to receive head 19 of bolt 18 to a depth sufficient to preclude head 19 from protruding beyond the surface of ball 13. Recess 12 may be left open as indicated in FIG. 2 or may be filled with a sealing, or potting, material such as silicone, epoxy, or the like. In an alternate embodiment, recess 12 may be eliminated and head 19 may be allowed to rest on the surface of ball 13. This provides for simpler construction, but presents a target to the trainee which does not have the exact characteristics of the actual ball to be used in the game for which he or she is training.

Ball 13 is detachably attached to rod 11 by passing bolt 18 consecutively through hole 16 in ball 13, hole 20 in spacer 15, and hole 21 in rod 11, having head 19 of the bolt in recess 12 and nut 17 attached to the end of bolt 18 as is known in the art. The positions of head 19 and nut 17 may be reversed if desired. Nut 17 is preferably of locking design as is known in 30 the art but may be non-locking to facilitate removal of ball 13 for storage or exchange with another ball. Washers (not shown) may also be employed as is known in the art if desired. The positions of head 19 and nut 17 relative to ball 13 may also be reversed if desired without varying from the present invention. Additionally as shown in FIG. 2A, a recess 12' may be made in rod 11 around hole 21 to receive nut 17 or head 19 in the same manner as described above for recess 12. In the preferred embodiment, a sheath of resilient material 22, similar to that used for handle 14, is placed around rod 11 to a length of about ten (10) inches, covering recess 12', in the vicinity of ball 13 to absorb the energy of blows received during the training.

In another embodiment, bolt 18 may be replaced by a rivet or other fastener having a head on one end and the other end being deformed to form a permanent connection of ball 13 to rod 11. Alternatively, hole 21 can be threaded to receive bolt 18 and nut 17 may be eliminated. Other fastening methods as are known in the art may be used to affix ball 13 to rod 11 through spacer 15 to practice the present invention.

Figures 3A, 3B:
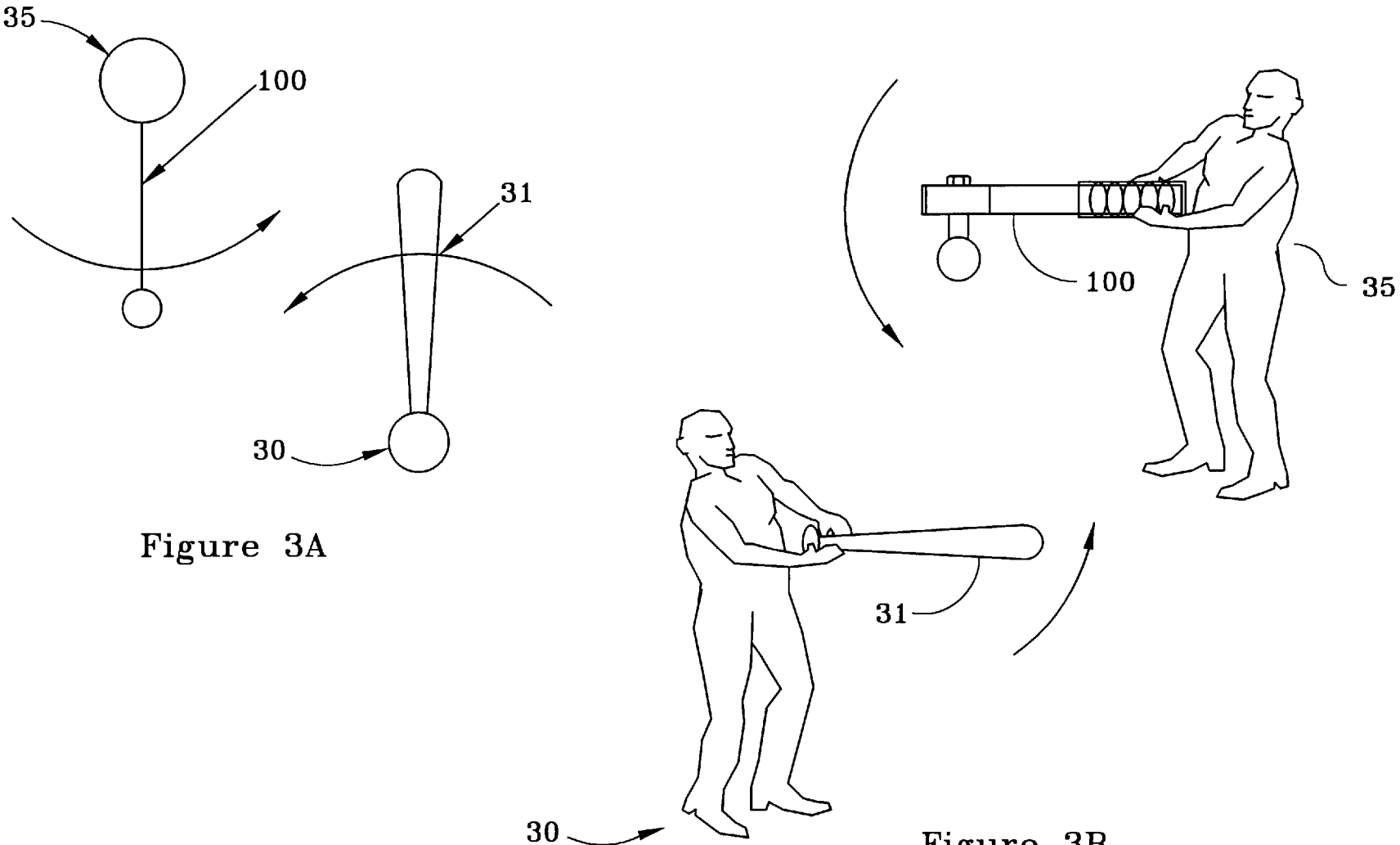
FIGS. 3A and 3B are plan and perspective views of the positions taken by the trainer and trainee when using the present invention.

Referring now to FIGS. 3A and 3B, the method for using apparatus 100 to teach a trainee to strike a baseball with a bat is described. A trainee, herein referred to as batter 30, represented by a circle 30 in FIG. 3A and a person 30 in FIG. 3B, stands in the customary position and posture for batting a ball. Batter 30 holds bat 31 in a ready position as determined by the trainer. A pitcher, herein referred to as trainer 35, represented by circle 35 in FIG. 3A and a person 35 in FIG. 3B, stands approximately 5 to 6 feet from and facing batter 30, holding apparatus 100.

Trainer 35 is displaced about 3 feet forward and 5 feet to the side of batter 30. These distances will vary from individual to individual, depending on size, batting style and other such factors. Trainer 35 holds apparatus 100 much in the manner of a baseball bat, but not fully retracted for a full back swing, with ball 13 oriented below rod 11. Trainer 35 may adopt a stance somewhat similar to a batter preparing to bunt a baseball. Trainer 35 then presents ball 13 to batter 30, using a motion that is similar to the motion of a person attempting to bunt a baseball. Thus, one hand is held at handle 14 while the other hand slides partway along rod 11, effectively moving ball 13 toward batter 30. The attitude and speed of presentation of ball 13, in both vertical and horizontal planes, can thus be completely controlled by trainer 35. For example, if batter 30 is a young child just learning to swing at a baseball, the ball can be presented very slowly and in a straight-on manner. On the other hand, if batter 30 is more advanced, ball 13 can be presented at higher speed and from a variety of angles. For advanced practice, trainer 35 can essentially fully swing rod 11, as if swinging a baseball bat, and ball 13 will be presented to batter 30 at a very high velocity. Simultaneously with presenting ball 13 for batter 30 to swing at, trainer 35 will typically provide verbal instruction.

Many variations in the use of apparatus 100 are possible. For example, a very strong trainer 35 may choose to hold rod 11 and present ball 13 with only one hand. In any case, trainer 35 may present ball 13 to batter 30 in a manner to emulate a curve ball, a sinker, or a fastball, all under complete control of trainer 35 since ball 13 is in essentially rigid connection to and under the control of trainer 35. Trainer 35 can vary the presentation of ball 13 to batter at will, providing maximum flexibility for trainer 35 to tailor the lesson to batter 30. This allows batter 30 to experience swinging at a ball numerous times in a very short training period since the only time between swings required is that necessary for batter 30 to reposition himself.

From the viewpoint of a coach, the use of the present invention provides essentially instantaneous feedback to the trainee by virtue of the ability to stop the action at any point, beginning with the presentation of the ball, through the contact of bat with ball, and through the completed full stroke of the batter. This instantaneous feedback can be used to allow for the frequent changes in presentation discussed above. Furthermore, it has been found that if the trainer holds rod 11 with a degree of flexibility, then after contact of the bat with the ball, the ball will move in a direction which indicates what would have been the nature of an actual hit, e.g. a line drive, grounder, pop-up, etc. The visual indication is quite striking and very useful from an instructional viewpoint. Further, training time is more efficiently used because the trainer does not lose possession of the ball and the ball does not have to be retrieved after the batter swings at it.

In an alternative but similar manner, apparatus 100 can be used to instruct young ball players to catch a ball in a glove by presenting ball 13 to trainee 30 in a manner to simulate a thrown or batted ball. Such a teaching method is contemplated by the present invention. In this application, the trainee 30 is provided with a glove, and the trainer with apparatus 100. The trainee 30 and trainer 35 position themselves apart so that the trainer 35 can move apparatus 100 in such a manner to simulate a thrown or batted ball, moving the ball in an appropriate arc from an away position to the trainee's glove. With new or young trainees, the trainer may move the ball slowly, describing to the trainee what is occurring and what the trainee should be doing at each moment. As the trainee becomes more proficient at catching the ball, trainer 35 may increase the speed at which ball 13 is presented to trainee 30.

The present invention has been particularly shown and described with respect to certain preferred embodiments of features thereof. However, it should be readily apparent to those of ordinary skill in the art that various changes and modifications in form and details may be made without departing from the spirit and scope of the invention as set forth in the appended claims.

What is claimed is:

1. An apparatus for use by a trainer to train a trainee to strike the apparatus with a bat, the apparatus comprising:

an elongated rod having a distal end and a proximal end for holding by the trainer;

a spherical ball-like object connected near the distal end of the rod at a substantially right angle in such a manner that the ball-like object is under substantial control of the trainer at all times; and means for connecting the ball-like object to the rod, wherein the ball-like object is spaced apart from the rod by a spacer, wherein the ball-like object and the rod each have a bore hole therein, and wherein the means for connecting the ball-like object to the rod passes through said bore holes in the ball-like object and rod.

2. An apparatus as in claim 1 wherein the spacer is a spring.

3. An apparatus as in claim 1 wherein the ball-like object is chosen from the group consisting of a baseball, a softball, a cricket ball.

4. An apparatus as in claim 1 wherein the ball-like object is detachably connected to the rod.

5. An apparatus as in claim 1 wherein the ball-like object is fixedly connected to the rod.

6. An apparatus as in claim 1 wherein the rod is substantially rigid.

7. An apparatus as in claim 1 further comprising a resilient gripping surface on the proximal end of the rod.

8. An apparatus as in claim 7 wherein the ball-like object is substantially rigidly connected to the rod.

9. An apparatus as in claim 7 wherein the ball-like object is chosen from the group consisting of a baseball, a softball, a cricket ball.

10. A method for providing batting practice to a batter, comprising:

providing the batter with a bat;

providing a trainer with an apparatus having an elongated rod having a distal end and a proximal end for holding by the trainer, a spherical ball-like object connected near the distal end of the rod at a substantially right angle in such a manner that the ball-like object is under substantial control of the trainer at all times, and means for connecting the ball-like object to the rod near the distal end, wherein the ball-like object is spaced apart from the rod by a spacer, wherein the ball-like object and the rod each have a bore hole therein, and wherein the means for connecting the ball-like object to the rod passes through the bore holes in the ball-like object and rod;

positioning the trainer and the batter facing one another in such manner that the batter is free to swing the bat at the ball-like object when the ball-like object is presented by the trainer; and the trainer presenting to the batter, in such manner that the ball-like object is under substantial control of the trainer at all times, the ball-like object to be struck by the batter.

11. The method of claim 10 wherein the step of the trainer presenting the ball-like object to the batter comprises the steps of:

the trainer grasping the proximal end of the rod; and moving the rod toward the batter to present to the batter the ball-like object to be struck by the bat.

12. The method as in claim 10 wherein the rod with which the ball-like object is connected is substantially rigid.

13. A method of providing catching practice to a trainee, comprising:

providing the trainee with a glove;

providing a trainer with an apparatus having an elongated rod having a distal end and a proximal end for holding by the trainer, a spherical ball-like object connected near the distal end of the rod at a substantially right angle in such a manner that the ball-like object is under substantial control of the trainer at all times and means for connecting the ball-like object to the rod near the distal end, wherein the ball-like object is spaced apart from the rod by a spacer, wherein the ball-like object and the rod each have a bore hole therein, and wherein the means for connecting the ball-like object to the rod passes through said bore holes in the ball-like object and rod;

positioning the trainer and the trainee facing one another; and the trainer presenting to the trainee, in such manner that the ball-like object is under substantial control of the trainer at all times, the ball-like object to be caught in the glove.

14. The method as in claim 13 wherein the rod with which the ball is connected is substantially rigid.

15. The method as in claim 13 wherein the step of the trainer presenting the ball-like object to the trainee further comprises the steps of:

the trainer grasping the proximal end of the rod; and moving the rod toward the trainee to present to the trainee the ball-like object to be caught in the glove.

* * * * *